United States Patent [19]

Pigeon et al.

[11] Patent Number: 4,521,150

[45] Date of Patent: Jun. 4, 1985

[54] DEVICE FOR POSITIONING A MEMBER FACING EACH OF THE PERFORATIONS OF A PERFORATED PLATE IN ACCORDANCE WITH A GIVEN GRID

[75] Inventors: Michel Pigeon, Bures sur Yvette; Robert Saglio, Antony, both of France

[73] Assignee: Commissariat a l'Energie Atomique, Paris, France

[21] Appl. No.: 364,974

[22] Filed: Apr. 2, 1982

[30] Foreign Application Priority Data

Apr. 10, 1981 [FR] France ..... 81 07243

[51] Int. Cl.[3] ..... B25J 5/00

[52] U.S. Cl. ..... 414/749; 165/76; 414/4; 901/16

[58] Field of Search ..... 165/11 A, 76; 414/749, 414/750, 590, 4, 5; 901/16

[56] References Cited

U.S. PATENT DOCUMENTS 3,913,752 10/1975 Ward et al. ..... 414/750
4,004,698 1/1977 Gebelin ..... 414/4
4,018,345 4/1977 Formaneck et al. ..... 414/750 X
4,168,782 9/1979 Sturges, Jr. ..... 414/4
4,193,735 3/1980 Savor et al. ..... 414/750 X
4,212,583 7/1980 Gebelin ..... 414/750 X

FOREIGN PATENT DOCUMENTS 0014616 3/1980 European Pat. Off. ..... 414/750 X
2394374 1/1979 France .

*Primary Examiner*—Joseph E. Valenza

[57] ABSTRACT

A device for positioning a member, such as a guide tube, so as to face the perforations of a plate. The device comprises a remotely fitted attachment finger, using for this purpose e.g. a pole onto which is threaded the remainder of the device. A remotely controlled locking system makes it possible to fix the two parts, each incorporating at least one attachment member and which can be fixed in a perforation. These displacements of the device, following the fitting thereof, are also remotely controlled. The device can be applied, to the inspection of the tubes of a steam generator of a nuclear power station by means of an eddy current probe or sensor.

7 Claims, 7 Drawing Figures

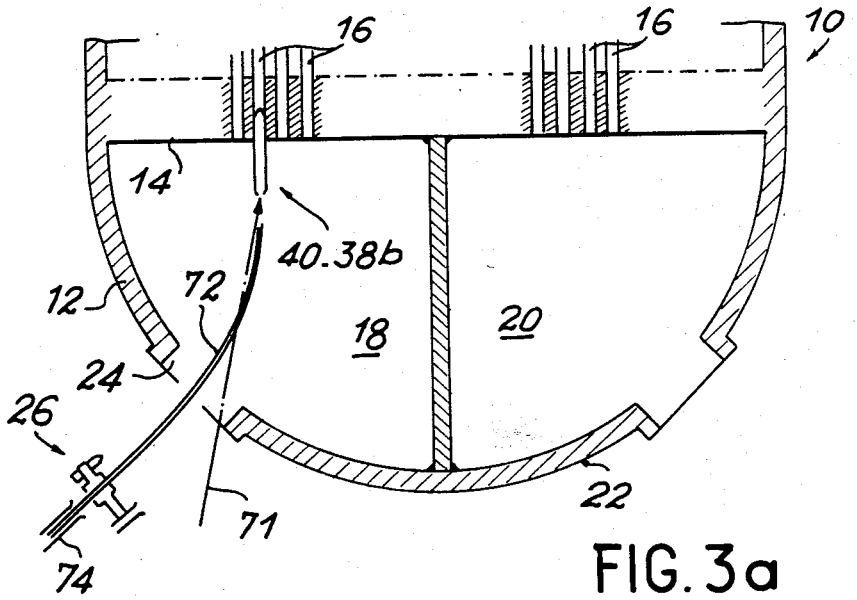
FIG. 3a
FIG. 3b
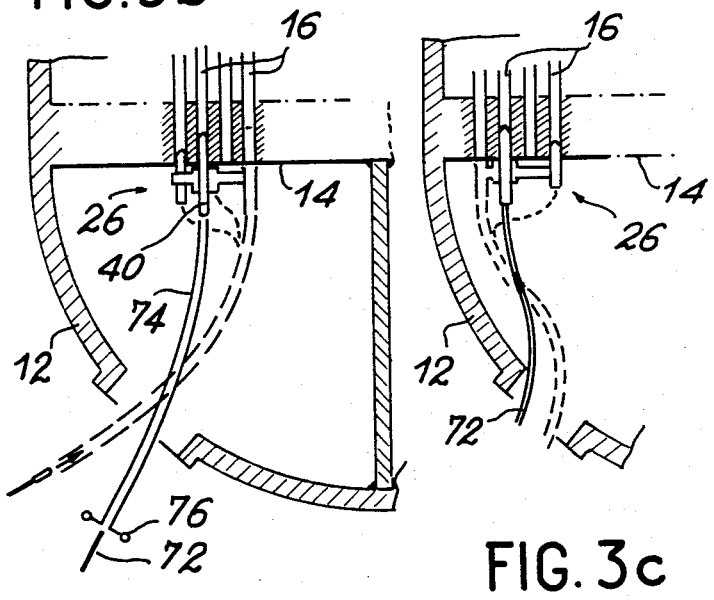
FIG. 3c

DEVICE FOR POSITIONING A MEMBER FACING EACH OF THE PERFORATIONS OF A PERFORATED PLATE IN ACCORDANCE WITH A GIVEN GRID

BACKGROUND OF THE INVENTION

The present invention relates to a device for positioning a member facing each of the perforations of a perforated plate in accordance with a given grid as well as to a process making it possible to remotely fit and dismantle such a device.

More specifically, the invention relates to a device making it possible to position a guide tube in such a way that it faces each of the tubes of a steam generator, such as those equipping nuclear power stations, in order to successively introduce into each of the said tubes a control device, such as an eddy current probe or sensor.

It is known that the tubes of steam generators used in nuclear power stations are exposed to particularly severe operating conditions making it necessary to periodically inspect these tubes in such a way that damaged tubes can be condemned by the sealing of each of their ends. For this inspection to take place, it must be possible to introduce an automatic device into the water box or tank of the steam generator, said device being controlled from the outside. Thus, it is desirable to reduce to a maximum and, if possible, eliminate human intervention within such water tanks, due to the highly irradiated nature of the latter and its small size. For the same reasons, the device must be as reliable as possible and must enable the checking of all the tubes, without any manual intervention being necessary. Moreover, the same requirements make it particularly desirable to construct the device in such a way that it can be remotely fitted and dismantled. Finally, the means ensuring the displacement of the device within the water tank of the generator must, if necessary, enable the jumping of one or more tubes. Thus, the sealed ends of condemned tubes prevent the use of the corresponding perforations of the plate for ensuring the displacement of the device.

A positioning device is known, which comprises two perpendicular arms provided with members permitting their independent fastening into the end of tubes and which can move with respect to one another in three perpendicular directions, so that the guide tubes carried by the arms can be made to face all the steam generator tubes.

This device makes it possible to carry out a complete, remote control inspection in a relatively short time of all the tubes of the steam generator. However, it has the disadvantage that an operator must manually install it in and remove it from the water tank. It must also be equipped with four or even five guide tubes, so as to allow a complete scan of the tube plate. Thus, the equipment permitting the injection of the eddy current probe must be disconnected from one of the guide tubes and connected to another of these tubes when the area to be reached makes this necessary. This operation necessitates a manual intervention, which it would be desirable to prevent for the reasons indicated hereinbefore. Moreover, the displacement of this device does not permit a correct scan of the tube plate when a large number of tubes have been condemned. Finally, the device has a by no means negligible weight, which is not always compatible with the operations to which it is exposed.

BRIEF SUMMARY OF THE INVENTION

The object of the present invention is to provide a simple device making it possible to perform an automatic, fast, reliable and complete inspection of all the tubes of a steam generator without requiring any human intervention in the generator's water tank. The invention also relates to a process for fitting and dismantling such a device.

In order to first ensure access to all the perforations of the plate with the same guide tube and then to greatly reduce the weight of the device, the present invention proposes a device for positioning a member so as to face each of the perforations of a perforated plate in accordance with a given grid. It comprises a body carrying at least two displaceable attachment members that can be introduced into or removed from a facing perforation. The body is in at least two parts, each of which carries one of the attachment members.

Such a device presents the advantage to be able to move according to two directions XY, which greatly simplifies the control of the displacement covered from one opening of the tube plate to another.

Preferably, the attachment members are aligned on one or several parallel rows of perforations.

Furthermore and still according to the present invention, one is proposed a device for positioning a member so as to face each of the perforations of a perforated plate in accordance with a given grid, comprising a body carrying at least two attachment members, means for displacing these members in a direction perpendicular to the plate and independently of one another, so that they can be introduced into or removed from a facing perforation, means for fixing each of the attachment members into a perforation and means for displacing one of the members relative to another, wherein it comprises an attachment or fastening finger having a guidance surface on which is detachably fitted the remainder of the device and remote locking means making it possible to fix the remainder of the device to the attachment finger, the latter incorporating one of attachment members.

As a result of these characteristics, it is clear that the attachment finger can be remotely fitted by means of a pole or hook member and that the remainder of the device can be remotely threaded onto the guidance surface, e.g. by fitting a flexible tube on the finger prior to the installation thereof.

According to a first embodiment of the invention, the remote locking means comprise a latch, whose pivoting is remotely controlled by an electric motor.

According to a second embodiment of the invention, the remote locking means comprise a catch which engages in a notch, and an unlocking pin which disengages the catch from the notch when subject to the action of appropriate means such as a ring, whose displacement is remotely controlled by means of a table or any similar means.

Preferably, the attachment members are aligned on the same row of perforations and the means for displacing one of the members relative to the other comprise means for displacing each member with respect to the other in the direction defined by said row of perforations over a distance equal to at least one spacing of the grid, in order to bring about a stepwise displacement of the device in said direction and means for pivoting the device about at least one of the attachment members in order to change the displacement direction of the device, the body being in at least two parts, each of which carries one of the attachment members.

According to a first variant, the device comprises two attachment members.

According to a second variant, the device comprises three aligned attachment members and the attachment finger then incorporates the intermediate member.

The invention also relates to a process for the remote fitting of such a device into the water box or tank of a steam generator, wherein it comprises the following stages:

placing the attachment finger in a perforation of the plate by means of a pole and using a manhole formed in the water tank, and a semi-rigid guidance member connecting the attachment finger to the outside of the water tank whilst passing through the manhole, fitting the remainder of the device by threading onto the guidance member, and locking the remainder of the device onto the attachment finger.

BRIEF DESCRIPTION OF THE DRAWINGS

The invention is described in greater detail hereinafter relative to non-limitative embodiments and the attached drawings, wherein show.

Figure 1:
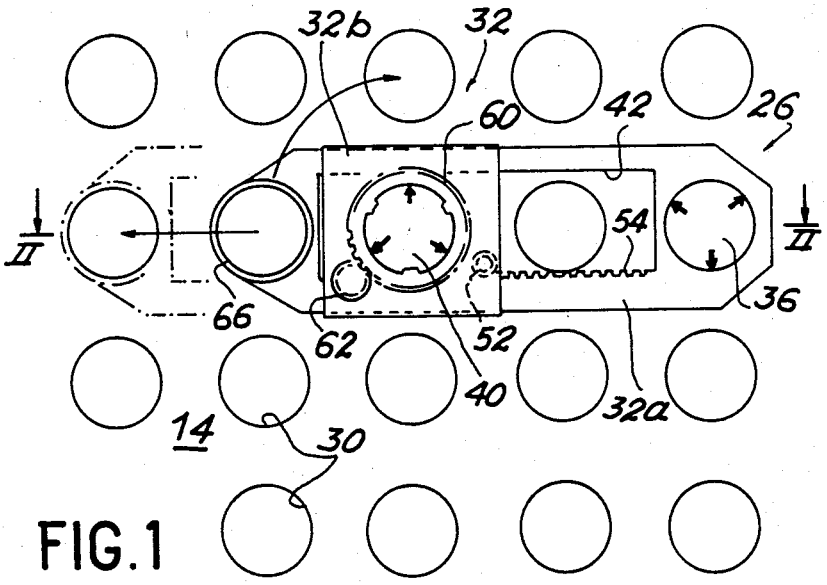
FIG. 1 a view from below illustrating a first embodiment of the device according to the invention attached below the tube plate of a steam generator.
Figure 2:
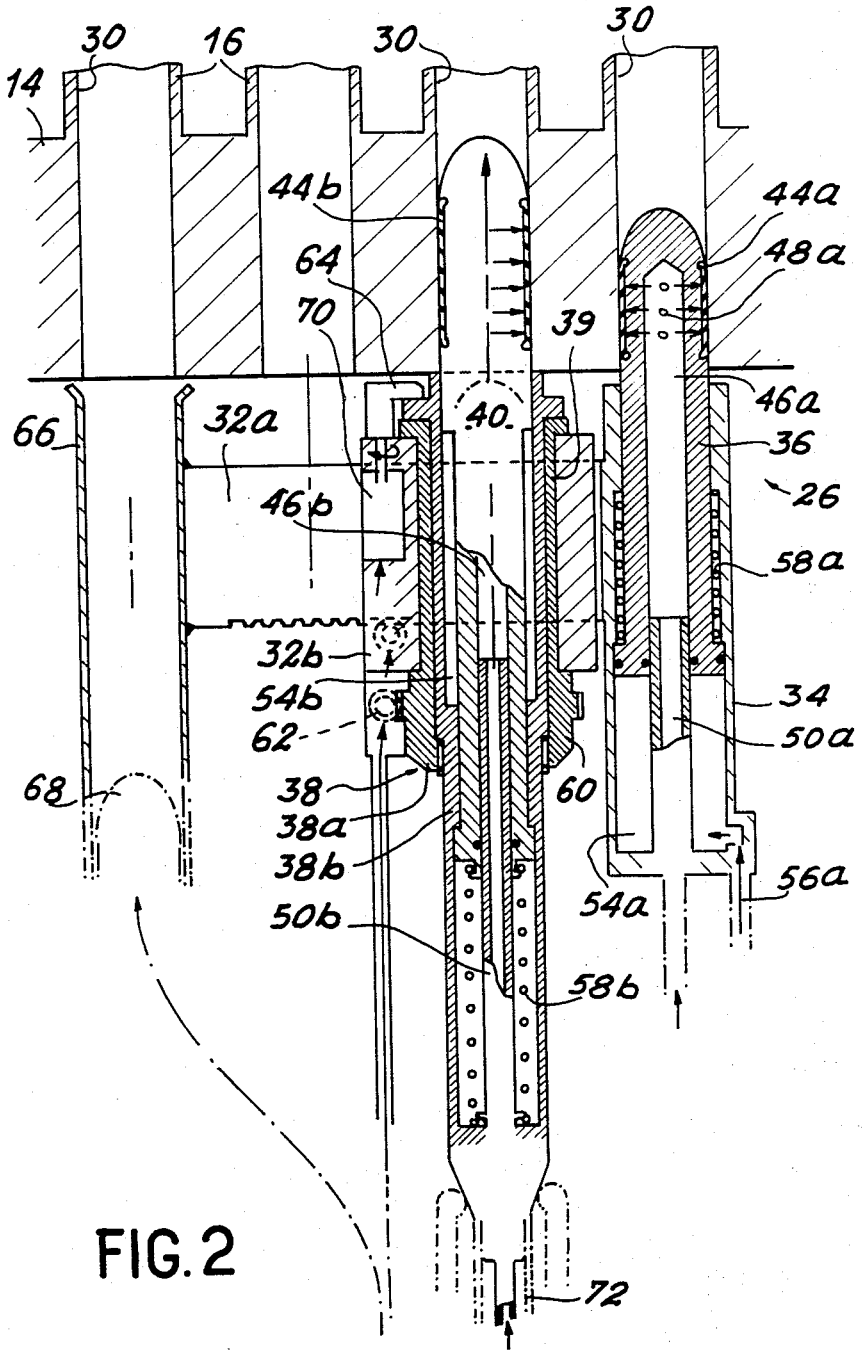
FIG. 2 a sectional view along line II—II of FIG. 1.

FIGS. *3a* to *3c* different stages of the process of fitting the device according to FIGS. 1 and 2 within one of the chambers of a water tank of a steam generator, whose lower end is diagrammatically shown.

Figure 4:
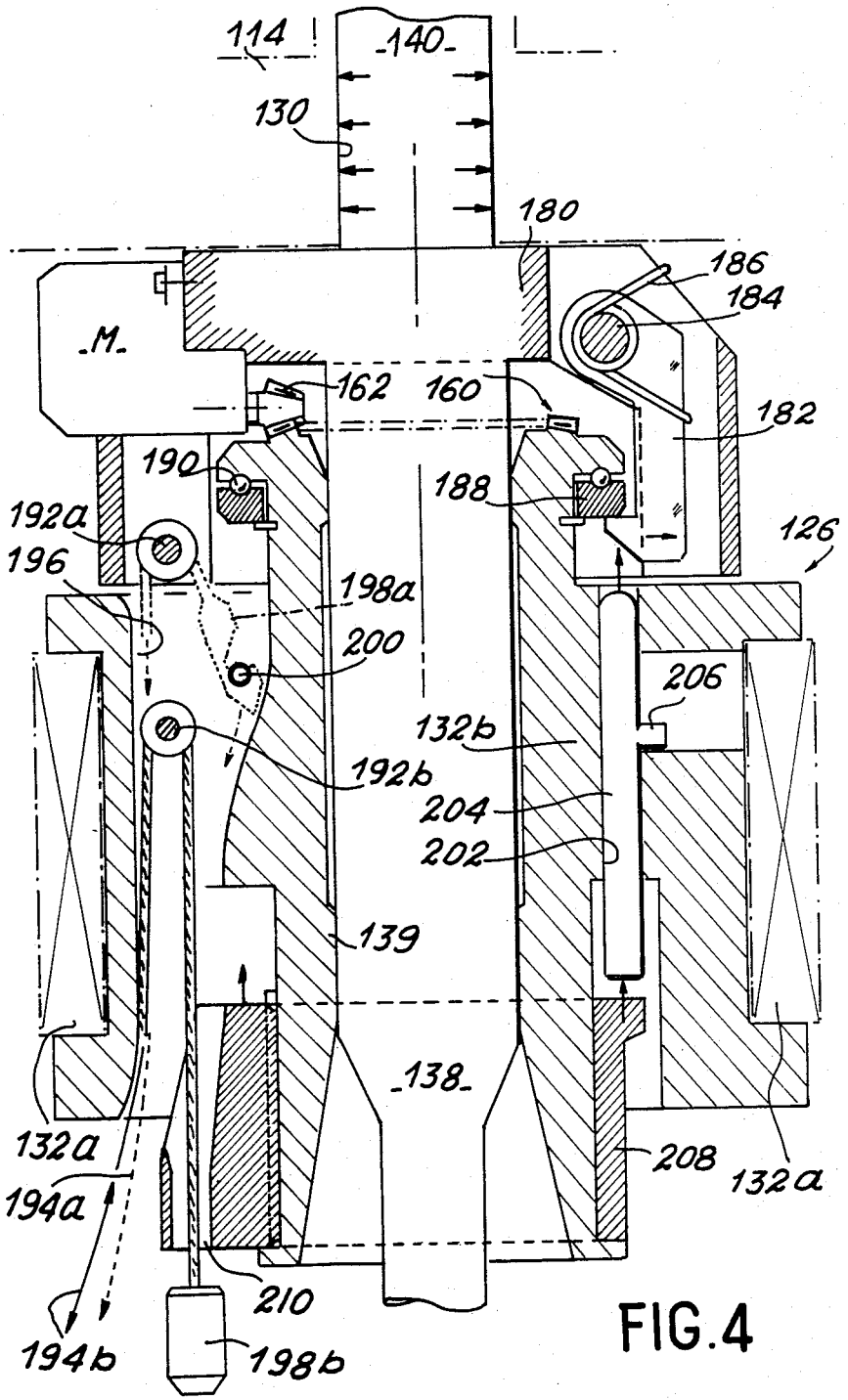

FIG. 4 a cross-sectional view illustrating a second embodiment of the invention and more particularly the means controlling the remote locking and unlocking of the device with respect to its centering finger.

Figure 5:
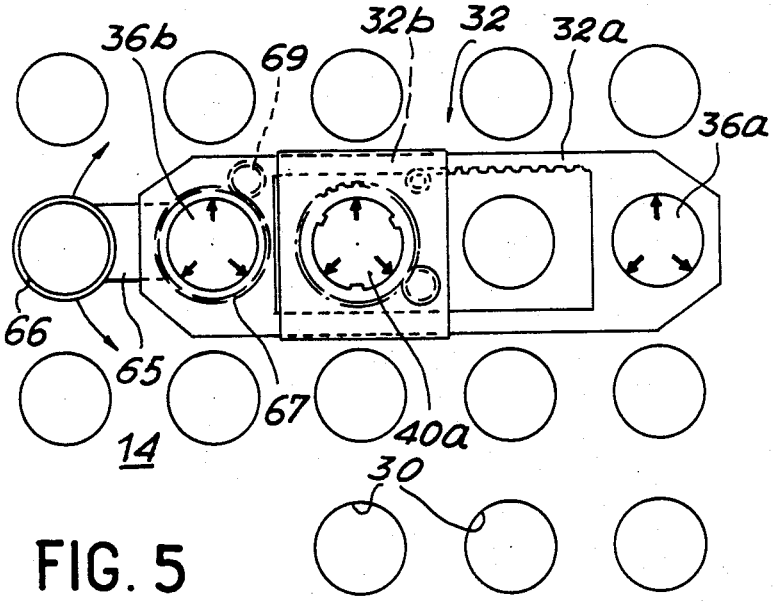

FIG. 5 a view from below comparable to FIG. 1, illustrating a constructional variant of the device according to the invention.

DETAILED DESCRIPTION OF THE PREFERRED EMBODIMENTS

FIGS. 1 and 2 show a small part of the tube plate 14 of a steam generator intended, for example, for ensuring the heat exchange between the primary and secondary circuits of a nuclear power station. The tube plate 14 has a very large number of holes or perforations 30 in which are fixed U-shaped tubes, whereof only the lower end is shown at 16 in FIG. 2. The ends of tubes 16 issue into the inlet and outlet chambers of a water tank or box defined below tube plate 14. In the constructional variant shown in the drawings, the perforations 30 in tube plate 14 define a square mesh grid. However, in not shown variants, the grid formed by the perforations can differ and can in particular define meshes in the form of equilateral triangles.

According to the invention, a device 26 can be introduced into one of the chambers of the water tank of the steam generator by a remote manipulation process to be described hereinafter. This device is designed in such a way that it can be attached to perforations 30 and can move along said perforations by means of an appropriate remote control system. Device 26 makes it possible to remotely inspect all the tubes 16 by means of an eddy current probe or sensor introduced by one or more guide tubes 66, in the manner to be described hereinafter. Device 26 is also designed in such a way that this inspection can be performed as rapidly as possible and to take account of the fact that certain of the tubes are sealed and cannot therefore be used for its attachment.

In order to take account of the various requirements, it can be seen in FIGS. 1 and 2 that the device according to the invention, according to a first embodiment, comprises a body 32 having a linear part forming a slide 32*a* and a sliding member 32*b*, which can move on part 32*a*. The linear member 32*a* at one of its ends defines a vertical cylinder 34 in which is slidingly received a piston-like attachment member 36.

For its attachment in a tube 30, the end of member 36 is peripherally covered with a flexible diaphragm 44*a* sealingly fixed to member 36 in such a way that it can be inflated by means of a pressurized fluid such as air. This fluid is injected by an axial passage 46*a* and radial holes 48*a* opening onto the inner face of diaphragm 44*a*. The fluid can be injected into passage 46*a* by a flexible tube 50*a* sealingly connected to the lower end of cylinder 34. The effect of the inflation of diaphragm 44*a* is to compress the latter against the wall of the tube, thus ensuring the fixing of member 36.

The other end of part 32*a* rigidly carries the represented variant guide tube 66, which is connected to a not shown system for the injection of the external eddy current probe using a flexible tube traversing the manhole, in the same way as the group of control pipes and cables for device 36. At 68 is diagrammatically shown the end of an eddy current probe on the point of being injected into one of the steam generator tubes.

As shown in FIGS. 1 and 2, the distance separating the axis of piston 36 from the axis of guide tube 66 is equal in this case to four times the spacing defined by the grid or network of perforations 30. Thus, when the end of fixing member 36 is introduced into a perforation 30, guide tube 66 is placed facing another perforation 30 separated from the first by two intermediate perforations.

Like part 32*a*, sliding member 32*b* comprises a vertical axis cylinder 38, which slidingly receives a piston-like attachment member 40. Like member 36, member 40 can be attached by its end to the inside of a perforation 30. For this purpose, it is also provided with a flexible cylindrical diaphragm 44*b*, whose ends are sealingly fixed to member 40 in such a way that diaphragm 44*b* can be pressed against the inner wall of the facing perforation by applying a pressurized fluid such as air to its inner face. This fluid is injected by a central passage 46*b* supplied by a flexible tube 50*b*, passing into a guide tube 72 on the outside of cylinder 38.

Part 32*a* has a central opening 42 for the passage of sliding member 32*b*, as can be seen in FIG. 1. More specifically, opening 42 is designed so as to permit sliding member 32*b* to move between two positions in which the axis of member 40 is aligned with one or other of the perforations 30 located between attachment member 36 and guide tube 66. For controlling the relative displacement between part 32*a* and sliding member 32*b*, means are provided which, in the represented embodiment, are constituted by a not shown electric motor carried by sliding bar 32*b* and controlling the rotation of a pinion 52, which engages on a rack 54 formed on linear part 32*a*.

In addition, means are provided for controlling the displacement of attachment members 36 and 40, respectively within cylinders 34 and 38, in order to introduce said members into perforations 30, as well as to remove them from said perforations. In the constructional variant of FIG. 2, in the case of member 36 these means are constituted by variable volume chambers 54*a* defined between cylinder 34 and member 36. A pressurized fluid such as air can be injected into chamber 54*a* by a tube 56 in order to draw member 36 towards the interior of a perforation 30. A spring 58*a* acts in the opposite sense for removing the end of member 36 from perforation 30 when the pressure is reduced. A comparable displacement of attachment member 40 can be obtained by means of a variable volume chamber 54*b* supplied by a not shown pipe and an opposing spring 58*b*.

As a result of the combination of features described hereinbefore it is possible to move the guide tube 66 stepwise along a row of perforations 30 for inspecting the tubes corresponding to the said row. Thus, on starting from the position shown in FIG. 2, in which attachment members 36 and 40 are fixed in two adjacent perforations and on wishing to move to the left, it is merely necessary to deflate diaphragm 44*b* in order to disengage the latter from the inner wall of the corresponding perforation 30, followed by the removal of member 40 from said perforation by reducing the pressure in chamber 54*b*. The motor controlling the displacement of sliding bar 32*b* with respect to slide 32*a* can then be put into operation so as to bring sliding bar 32*b* into the position shown in FIG. 1. The reverse operations to those described hereinbefore are then carried out in order to introduce member 40 into the perforation 30 contiguous to that which it has just left and fix said member in said first perforation by inflating diaphragm 44*b*. Slide 32*a* carrying guide tube 66 can then be displaced after reducing the pressure within diaphragm 44*a* and after removing attachment member 36 from the perforation in which it was fixed. The device is then in the position shown in FIG. 2 having advanced by one spacing along the row in question. Obviously, a displacement in the reverse direction could be obtained by moving slide 32*a* before sliding bar 32*b*.

To enable device 26 to inspect all the rows of perforations of tube plate 14, means are provided making it possible to pivot slide 32*a*, as well as attachment member 36 and the guide tube 66 which it supports around attachment member 40. This rotation enables the device to pass from one row to the next and also reach the not easily accessible tubes.

In the constructional variant of FIG. 2, this rotation is obtained by mounting cylinder 38 in rotary manner in sliding bar 32*b* and by providing teeth 60 on the cylinder in which mesh a pinion 62 controlled by a not shown electric motor and carried by sliding bar 32*b*.

Obviously, the rotations of device 26 around attachment member 40 are controlled as a function of the configuration of the grid of perforations 30 formed on the tube plate. Thus, in the case of a square mesh grid, as shown in FIG. 1, the rotations will be 90° or 180°, whereas they would be 60°, 120° or 180° in the case of a grid with equilateral triangular meshes.

In a not shown constructional variant, based on a square mesh grid, it is possible to envisage a device which can move diagonally. This device would differ from that of FIGS. 1 and 2 by the location of the guide tube in the vicinity of attachment member 36 and the elongation of part 32*a* increasing the available travel of sliding bar 32*b*. The rotation of part 32*a* about member 40 can also be 45°.

According to the invention and in order to permit remote fitting and dismantling of the complete device, in the manner described hereinafter, attachment member 40 and its cylinder 38 constitute an attachment finger, which can be fitted independently of the remainder of the device. This remainder is installed and subsequently locked to said finger. For this purpose, FIG. 2 shows that the cylinder is constructed in two parts 38*a*, 38*b*, which co-rotate by grooves or any similar not shown means. However, they are able to slide in one another in such a way that outer part 38*a* and the remainder of the device 26 to which it is connected can slide downwards on a guidance surface 39 formed on the inner part 38*b* in which is located attachment member 40 to permit the remote fitting and dismantling of device 26 with respect to member 40.

In the constructional variant of FIG. 2, the remainder of device 26 is locked to the inner part 38*b* of the cylinder by means of a pivoting latch 64 mounted on the upper part of sliding bar 32*b* and whose rotation is controlled by an electric motor 70. The latter enables latch 64 either to bear on a collar or flange formed in the upper portion of part 38*b* of the cylinder in order to lock device 26, or to disengage said collar or flange in order to permit the dismantling of the remainder of the device.

The operations of fitting the device shown in FIGS. 1 and 2 into the water tank of a steam generator will now be described with reference to FIGS. 3*a* to 3*c*.

In FIG. 3*a* it is possible to see the lower end of a steam generator 10, whose horizontal tube plate 14 has a large number of U-shaped tubes 16, whereof only the lower end is shown. The inlet and outlet ends of tube 16 respectively issue into inlet chamber 18 and outlet chamber 20 of water tank 22 of generator 10. The outer wall 12 of each of the chambers 18 and 20 is provided with a manhole 24 via which, according to the present invention, it is possible to remotely introduce, i.e. without anybody having to enter water tank 22, device 26 in order to inspect the tubes, e.g. by means of an eddy current sensor.

During the first stage of the fitting process, attachment finger 38, 40 is introduced e.g. into chamber 18 by means of a pole or hook member 71. The end of the attachment member 40 is then remotely introduced by means of pole 71 and through manhole 24 into one of the perforations 30 of tube plate 14. Pressurized fluid is injected by tube 50*b* in order to fix member 40 in said perforation. It can be seen in FIG. 3*a* that the remainder of the device 26 is then threaded onto flexible tube 72 around which is threaded a second tube 74 terminated, in the manner shown in FIG. 3*b*, by a handwheel 76 or some similar system making it possible to remotely orient device 26. By sliding device 26 and tube 74 along tube 72, the remainder of device 26 on guidance surface 39 can easily be brought without human intervention into the interior of the water tank. It is then merely necessary to remotely control motor 70 in order to pivot latch 64 in order to bring it above the collar formed at the upper end of part 38*b* of the cylinder and thereby lock device 26. This operation is also remotely performed, because device 26 is introduced into the water tank with the group of cables and pipes ensuring its control, as well as with the flexible piping connected guide tube 66 to the injection apparatus of the eddy current probe. FIG. 3*c* shows the thus fitted device 26, after dismantling flexible tube 72 and the removal thereof.

FIG. 4 shows a variant of the device according to FIGS. 1 and 2, which essentially differs from the latter through the construction of the means permitting the remote attachment and disengagement of the device with respect to the attachment finger. The parts which are not described are similar to those of the first embodiment. In this variant, the same reference numerals, increased by 100 are used to designate similar elements to those of the first embodiment.

It can be gathered from FIG. 4 that cylinder 138 in which is located attachment member 140, whose end is introduced into a perforation 130 of a tube plate 114, carries at its upper end a support 180 on which is received on the one hand a motor M controlling the rotation of a horizontal axis pinion 162 and on the other hand a downwardly directed catch 182 mounted so as to pivot about a horizontal shaft 184. A torsion spring 186 pulls catch 182 towards the axis of member 140 in the position shown in the drawing.

Pinion 162 engages on a crown gear 160 formed in the upper part of sliding bar **132*b*, which is in this case shown in cross-section, as well as slide 132*a* on which it slides. Besides crown gear 160, sliding bar 132*b* has on its upper part a collar, which is positioned above the end of catch 182 when the latter occupies the position shown in the drawing. Between the end of the catch and the collar, there is a ring 188 on which the collar bears via a ball bearing 190. This bearing is needed because slide 132*b*, as well as the remainder of device 126 can rotate about cylinder 138, as in the variant of FIGS. 1 and 2. Thus, normally the end of catch 182 is engaged in a recess of sliding bar 132*b* formed below ring 188**.

Support 180 also carries a pulley **192*a* on which can slide a cable 194*a* passing through an opening 196 formed in the sliding bar. The outer end of cable 194 is extended out of the steam generator water tank, whilst the inner end carries a hook 198*a* which can be attached to a handle 200** formed on the sliding bar.

In its part positioned beneath catch 182, sliding bar **132*b* also has a vertical opening 202 aligned with the end of catch 182 when it occupies a position corresponding to the dismantling of the device and in which slides a rod 204 normally maintained in the lower position by a finger 206, in such a way that it projects by its lower end out of the sliding bar 132*b***.

A ring 208, slidingly mounted on sliding bar **132*b* and whose axis coincides with that of cylinder 138, is placed at the lower end of the sliding bar. More specifically, ring 208 is positioned below the projecting end of rod 204. Ring 208 also has a vertical hole 210 into which passes a second cable 194*b* mounted on a pulley 192*b* and whose other end passes out of the steam generator. The end of the cable which passes through hole 210 carries a part 198*b***, whose cross-section is greater than that of the hole.

The device described with reference to FIG. 4 functions in the following way. After fitting the finger comprising attachment member 140 and cylinder 138 in a manner comparable to that described with reference to FIG. 3*a*, cable **194*a* previously placed on pulley 192*a* is used for fitting the remainder of device 226. To this end, hook 198 is attached to handle 200 and pulling takes place on the free end of cable 194*a*. When device 226 arrives in the high part in the vicinity of plate 114, catch 182 is retracted and automatically maintains in place the remainder of the device. At this time, hook 198*a* of its own accord is lowered again through hole 210 by gravity and cable 194*a* is removed. Device 126** is then ready to operate.

When it is wished to unlock the remainder of the device from the attachment finger in order to dismantle the same, cable **194*b* is used. By pulling on the end of cable 194*b*, part 198*b* is made to abut against the lower part of ring 208, which then slides upwards. Ring 208, acting on rod 204, disengages the end of catch 182 from the corresponding recess and in opposition to spring 186. The slackening of cable 194*b* then makes it possible to lower device 126 again, only cylinder 138 and attachment means 140 remaining in place. It is then easily possible to remotely deflate attachment means 140** in order to lower the latter. As in the preceding variant, all the fitting and dismantling operations can be carried out remotely without it being necessary for an operator to intervene within the water tank.

Obviously, the invention is not limited to the embodiment described in exemplified manner hereinbefore and in fact covers all variants thereof. In particular, it can be seen in FIG. 5 that the linear part **32*a* of body 32 can comprise two similar attachment members 36*a* and 36*b* housed in cylinders fitted at each of the ends of part 32*a*. Obviously, the means controlling the fixing of members 36*a*, 37*a* in perforations 30 are similar to those described hereinbefore with reference to FIGS. 1 and 2. The same applies with regards to the means controlling the displacement of these members perpendicular to tube plate 14 for introducing said members into the ends of the tubes or for removing them from said ends, as well as the means controlling the relative displacement of the two parts 32*a* and 32*b* and the means controlling the rotation of the device about central member 40**.

As can be seen in FIG. 5, in this embodiment, the second attachment member **36*b* of part 32*a* of the device body takes the place of guide tubes 66 in the first variant described with reference to FIGS. 1 and 2**.

In exemplified manner, FIG. 5 also shows a variant in which the guide tube **66*b* is no longer directly fixed to part 32*a*, but is instead fitted to the end of an arm 65, which can pivot about the axis of attachment member 36*b* in such a way that guide tube 66*b* can be made to face three perforations 30 contiguous with perforations corresponding to member 36*b* and as illustrated by the arrows in FIG. 5. The means for controlling the rotation of arm 65 about member 66*b* can comprise, in the manner diagrammatically illustrated in FIG. 5, a rack wheel 67 fixed to arm 65, centred on member 36*b* and rotated by a not shown electric motor via a pinion 69**.

It is obviously possible to envisage other solutions and in particular several guide tubes can be rigidly mounted on part **32*a*** by arranging them e.g. at 90° with respect to the direction defined by said part.

Finally, it is clear that the means ensuring the remote control of the described devices are well known to those skilled in the art and do not form part of the present invention. The same applies regarding the apparatus controlling the injection of the eddy current probe or sensor.

Moreover, it is clear that the device has been described for a stepwise forward movement, but can also be adapted to a forward movement consisting of a random number of steps.

Of course, the various embodiments described herein above can undergo different minor modifications without going beyond the frame of the invention. Among these modifications, the following variants can be noted:

the rack system enabling the displacement between part **32*a* and the sliding bar 32*b*** can be replaced by two guiding rods symmetrically placed and by screw-jacks;

the sliding bar 32*b* can support several attachment members of the type of element 40; for example the sliding bar can support four elements placed on the corners of a square and fed, two by two, by two compressed air generators, which allows a better angular positioning and diminishes the risks of fall, each element is attached into a different opening of the tube plate;

in a similar manner, the guide bar 32*a* can also support several attachment members of the type of element 36 and for example two elements symmetrically placed;

when the sliding bar 32*b* supports four attachment members, one conceives that the guide bar 32*a* shows a rectangular shape; the guide tube can be then situated on one of the corners of the rectangle formed by the guide bar;

the electric motor controlling the rotation of the sliding bar 32*b* with respect to the guide bar 32*a* can be replaced by a rotative screw jack to which can be associated a reducer if necessary.

What is claimed is:

1. A device for positioning a member so as to face each of the perforations of a perforated plate in accordance with a given grid, comprising a body carrying at least two attachment members, means for displacing said members in a direction perpendicular to the plate and independently of one another, so that said members can be introduced into or removed from a facing perforation, means for fixing each of the attachment members into a perforation and means for displacing one of the members relative to another member, said device comprising a fastening finger including a first of said attachment members and a first part of said body carrying said first attachment member, said first part having a guidance surface on which is slidably fitted a second part of said body carrying the other of said attachment members, a semi-rigid guidance member connecting the fastening finger to a remote zone, and remote locking means normally fixing said second part of the body to the fastening finger when the second part of the body is fitted on said guidance surface, whereby said second part of the body carrying the other attachment members can be slid along said semi-rigid guidance member and on said guidance surface when said fastening finger has been fixed into a perforation.

2. A device according to claim 1, wherein the remote locking means comprise a latch, whose pivoting is controlled by a motor, so that it is made to face an appropriate surface.

3. A device according to claim 1, wherein the remote locking means comprise a catch, which engages in a notch under the action of elastic means and an unlocking pin which disengages the catch from the notch when subject to the action of appropriate unlocking means.

4. A device according to claim 3, wherein the unlocking means comprise a ring, which bears on the pin and whose displacement is remotely controlled by a cable means.

5. A device according to anyone of claims 1 to 4, wherein the attachment members are aligned on the same row of perforations and the means for displacing one of the members relative to the other comprise means for displacing each member with respect to the other in the direction defined by said row of perforations over a distance equal to at least one spacing of the grid, in order to bring about a stepwise displacement of the device in said direction and means for pivoting the device about at least one of the attachment members in order to change the displacement direction of the device, the body being in at least two parts, each of which carries one of the attachment members.

6. A device according to claim 5, comprising two attachment members.

7. A device according to claim 5, comprising three aligned attachment members and wherein the fastening finger comprises an intermediate member of said aligned attachment members.

* * * * *